United States Patent [19]

Danko

[11] 4,210,182

[45] Jul. 1, 1980

[54] METHOD OF MAKING A CHAIR

[76] Inventor: Peter J. Danko, 408 Gibbon St., Alexandria, Va. 22314

[21] Appl. No.: 693,837

[22] Filed: Jun. 8, 1976

[51] Int. Cl.[2] ..... B27D 1/08; A47C 5/00

[52] U.S. Cl. ..... 144/317; 29/416; 144/309 B; 144/315 A; 144/322; 156/196; 156/267; 297/418; 297/447; 297/419; 297/446

[58] Field of Search ..... 156/196, 267; 144/309 B, 313, 314 R, 315 R, 315 A, 316, 321, 322, 317; 297/418, 446, 447, 419, 421; 29/416

[56] References Cited

U.S. PATENT DOCUMENTS

| | | | |
|---|---|---|---|
| 1,385,387 | 7/1921 | Morandi | 144/316 X |
| 2,642,118 | 6/1953 | Lamb | 297/447 X |
| 2,649,147 | 8/1953 | Sanford | 297/447 X |
| 2,670,787 | 3/1954 | Vandas et al. | 297/447 X |
| 2,818,107 | 12/1957 | Thaden | 297/418 |

*Primary Examiner*—Robert Louis Spruill
*Assistant Examiner*—W. D. Bray
*Attorney, Agent, or Firm*—Jacob Shuster

[57] ABSTRACT

A stack of flat rectangular blanks are deformed in a single bending operation during which adhesive coatings between the blanks is activated to produce a laminated wood chair. Preceding the bending operation, the blanks are cut to remove a front end section and to form internal tongues struck out during the bending operation into rear leg elements. The removed front end section forms a rigid core for a seat cushion fitted onto the seat panel portion of the chair.

7 Claims, 10 Drawing Figures

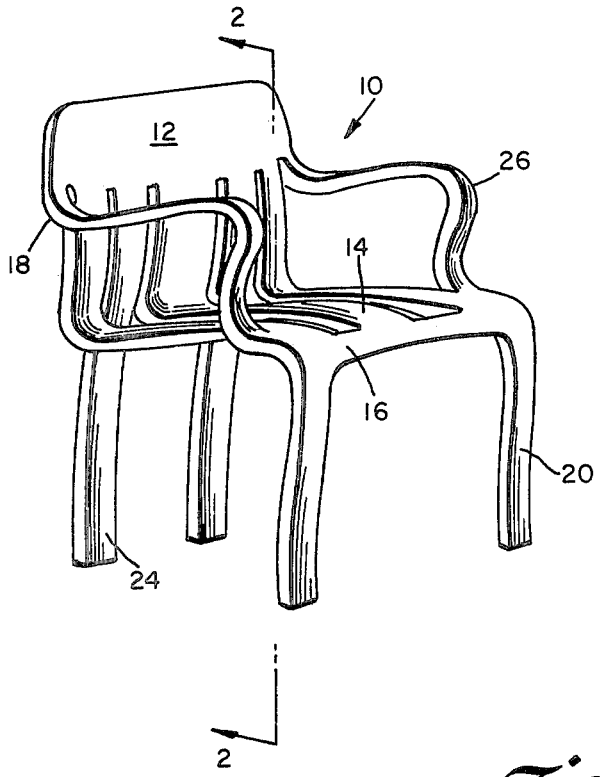
Fig. 1
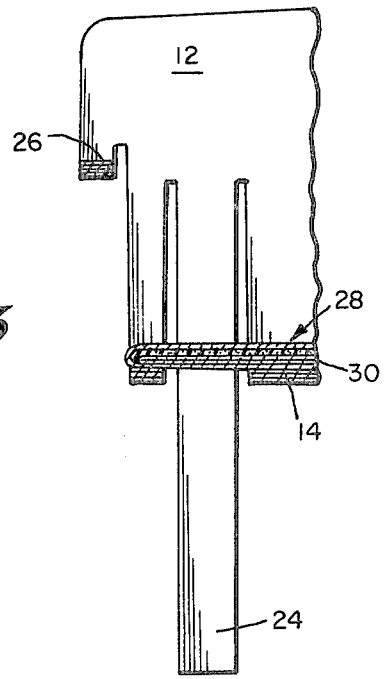
Fig. 3
Fig. 2
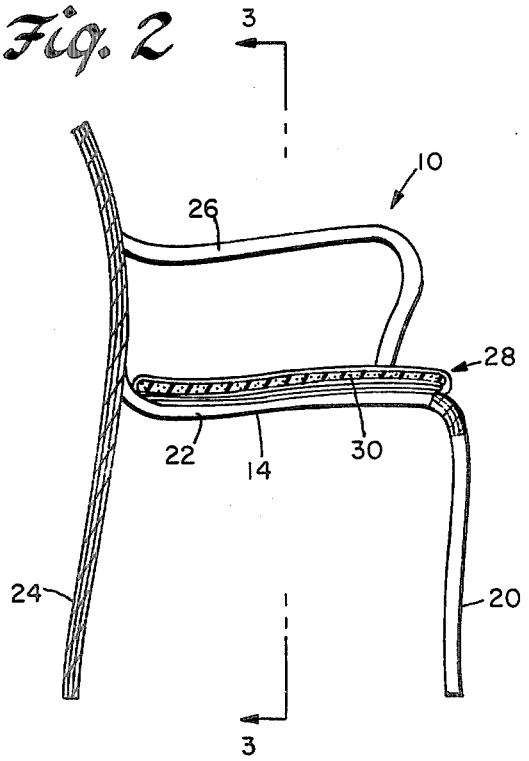
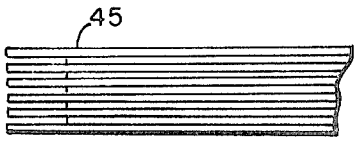
Fig 9.
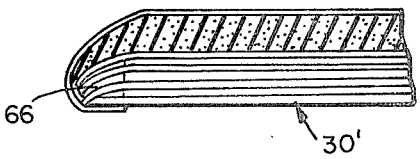
Fig. 10

METHOD OF MAKING A CHAIR

BACKGROUND OF THE INVENTION

This invention relates to chair constructions made of laminated wood or the like.

The construction of chairs from laminated wood is generally well known as disclosed, for example, in U.S. Pat. No. 1,385,387 to Morandi. The formation of wood laminates from flat stacks of panel layers while the panels are being bent into a desired shape, is also well known. Usually, adhesive coatings between the layers are electronically activated while the layers are under pressure between the bending dies in a bending press, as referred to in U.S. Pat. No. 3,878,015 to Johnston. The latter patent teaches that a curved laminated wood product may be formed during a single bending operation and yet be resistant to cracking and splitting and have the other necessary structural attributes for furniture or chair parts. The formation of chairs by folding of a single flat blank is expressly disclosed in U.S. Pat. No. 2,670,787 to Vandas et al.

Although the prior art as exemplified by the foregoing U.S. patents indicates that the technology has advanced to the point where laminated wood chairs may be completely formed in a single bending operation from a flat precut blank, no such product has been successfully marketed on a wide scale because of what are believed to be structural and economical as well as esthetic drawbacks. It is therefore an important object of the present invention to provide a one-piece laminated wood chair of pleasing appearance that has the requisite strength and is capable of being manufactured in an economically feasible fashion. A further object of this invention is to provide a one-piece, laminated wood chair capable of being easily molded and machined from a flat blank.

SUMMARY OF THE INVENTION

In accordance with the present invention a precut stack of flat wood blanks are deformed to a desired shape in a single bending operation during which adhesive coatings therebetween are activated resulting in a chair that is structurally complete, requiring only finishing operations.

The blanks are bent along a continuous, smooth and substantially two-dimensional curvature avoiding any relatively sharp folding. Toward that same end, the rear legs of the chair extend tangentially from the curvature along the back panel portion. Further, the rear legs are struck out of internal slots formed in the back and seat panel portions of the blanks spaced from the longitudinal side edges thereof. The rear legs are thereby capable of supporting the expected loads applied thereto without requiring an excessively thick laminate.

The blanks are also cut to a substantially rectangular shape with internal slots to minimize weakening of the blanks and unintentional rupture of portions from the main body of the blanks when subjected to the high bending pressures in the bending press. The foregoing cutting and bending arrangement also facilitates finishing of the chair by trimming and/or abrading operations because the exposed cut edges remain in parallel spaced planes along which rotating tool discs may be displaced relative to the product after it is removed from the bending press.

As a further economy measure, the front leg panel portion of the blanks have a section removed therefrom to not only define laterally spaced front leg elements along the sides and laterally spaced from the rear legs, but to also form the core of a seat pool or cushion that fits onto the seat panel portion of the chair bridging the internal slots. The resulting product produced not only has the desired strength and rigidity, but also has an esthetically pleasing appearance and provides the desired comfort for the occupant.

BRIEF DESCRIPTION OF THE DRAWING FIGURES

FIG. 1 is a perspective view of a chair constructed in accordance with the present invention.

FIG. 2 is a side sectional view taken substantially through a plane indicated by section line 2—2 in FIG. 1.

FIG. 3 is a partial sectional view taken substantially through a plane indicated by section line 3—3 in FIG. 2.

FIGS. 9 and 10 are sectional views of a modified seat cushion.

DETAILED DESCRIPTION OF PREFERRED EMBODIMENTS

Figure 4:
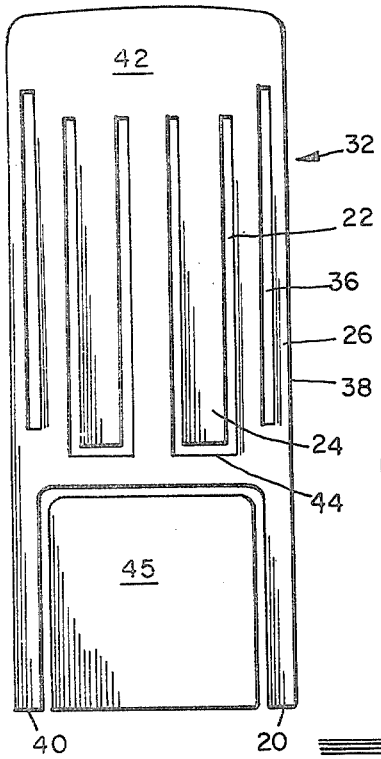
FIG. 4 is a top plan view of a cut blank from which the chair of FIG. 1 is bent.

Referring now to the drawings in detail, FIGS. 1 and 2 illustrate a chair 10 constructed in accordance with the present invention. The chair includes a back panel portion 12, a seat panel portion 14 and a front leg panel portion 16. The foregoing panel portions 12, 14 and 16 form a smooth, continuous and substantially two-dimensional curvature and are made of a single, unitary piece of material of substantially uniform thickness with edge portions that may be sightly tapered in a manner well known in the art. Preferably, the unitary piece of material is laminated wood with all of the exposed edges 18 being finished by some abrasive.

The front leg panel portion 16 has laterally spaced leg elements 20 formed along the side edge of the blank while the seat and back panel portions 14 and 12 have a pair of laterally spaced internal slots 22 formed therein from which a pair of rear legs 24 are struck out extending tangentially from the curvature of the back panel portion 12 in substantially parallel and laterally spaced relation to the front legs 20. Also in the embodiment illustrated, a pair of arm rest formations 26 project from the back and front panel portions at the longitudianal sides of the chair. As shown in FIGS. 2 and 3, a padded seat cushion or seat pad 28 is fitted onto the seat panel portion 14 to bridge the gaps therein formed by slots 22 and comfortably support the chair occupant. Any suitable and conventional seat cushion construction may be utilized incorporating a rigid core 30 made of the same laminated wood material as the rest of the chair.

FIG. 4 shows a substantially rectangular stack of flat blanks 32 from which the chair 10 if formed. A plurality of such blanks constituting wood panel layers are stacked to a desired thickness for cutting and bending operations. A suitable adhesive coating is applied between the layers so as to form a laminate during the bending or molding operation. The adhesive may be activated electrically or in response to the bending pressure applied as disclosed in U.S. Pat. No. 3,878,015 to Johnston, aforementioned.

The blanks 32 are cut by punching tools, for example, during the cutting operation to form the pair of internal slots 22 as shown in FIG. 4. The slots 22 define tongues 24 constituting the struck out rear legs aforementioned. A pair of single slots 36 are also cut into the blanks laterally spaced between the longitudinal sides 38 and the slots 22 to define the material from which the arm rests 26 are formed. The slots 22 and 36 terminate at one end of the front leg panel portion spaced from front end 40 of the blank and extend toward the other end 42. The each of the slots by 22 includes laterally spaced portions parallel to each other except for the bridging portions 44 terminating the rear leg tongues 24 at free ends as shown adjacent to the front leg portion. At the front end 40 of the blank, the sections 45 are cut out to form the seat cushion core 30 aforementioned and to define the front leg elements 20.

Figure 5:
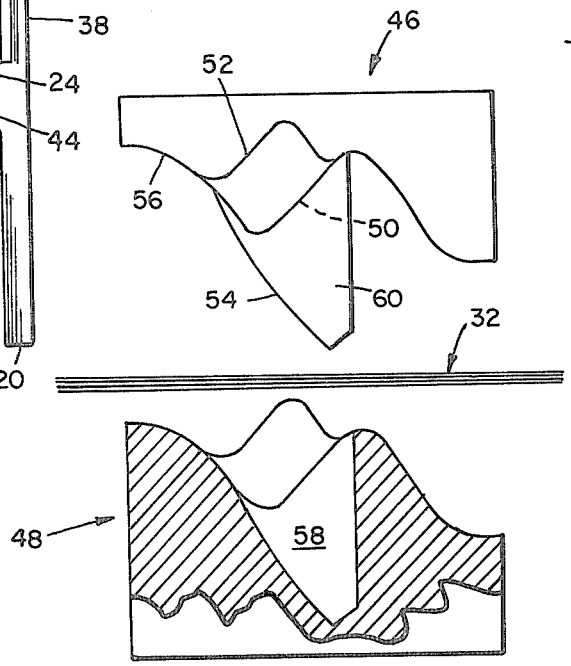
FIG. 5 is a side elevation view with parts shown in section of the bending dies and stack of blanks in position prior to the bending operation.
Figure 6:
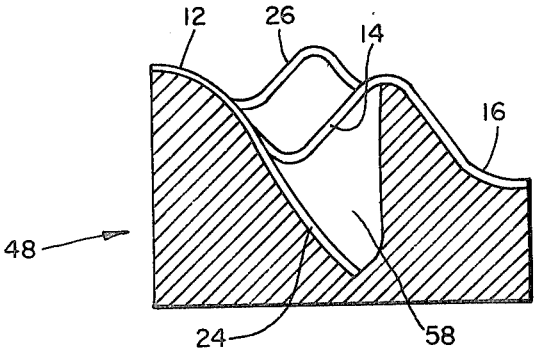
FIG. 6 is a side section view of the female bending die with the product bent therein following a bending operation.

As shown in FIG. 5, the stacked blanks coated with adhesive is positioned within a conventional bending press (not shown) between male and female bending dies 46 and 48. These dies have complementary curved bending surfaces which include a base curvature 50 from which the back, seat and front leg panel portions are formed, an arm rest curvature 52 and the rear leg curvature 54, all three curvatures deviating from each other tangentially at point 56. The female die 48 is provided with laterally spaced cavities to receive the projections 60 from the male die 46 on which the curved surfaces 54 are formed. The blanks are accordingly bent to the desired shape in one bending operation as shown in FIG. 6 as the separate dies are advanced into each other with the blanks therebetween, within the bending press.

Figure 7:
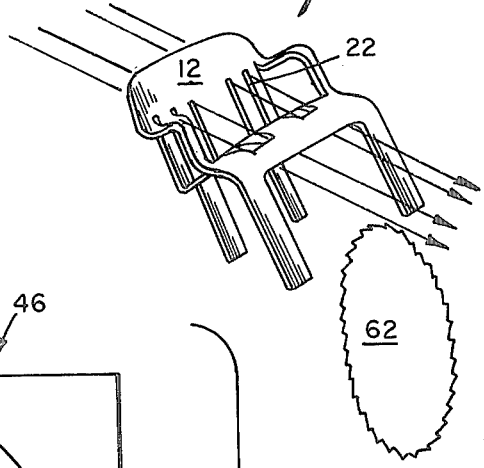
FIG. 7 is a section view similar to FIG. 3, showing a finishing operation.

Then the product is removed from the bending dies, it undergoes the usual finishing operations such as trimming of exposed cut edges to remove extruded adhesive and abrading to smooth rough edges before any further finishing operations are performed. Since most of the cut edges are parallel to each other and remain so after bending, trimming and abrading operations are facilitated. Thus, a rotating trimming or abrading disc 62 may be inserted into the slots 22 as shown in FIG. 7 to finish the edges bordering the slots.

Figure 8:
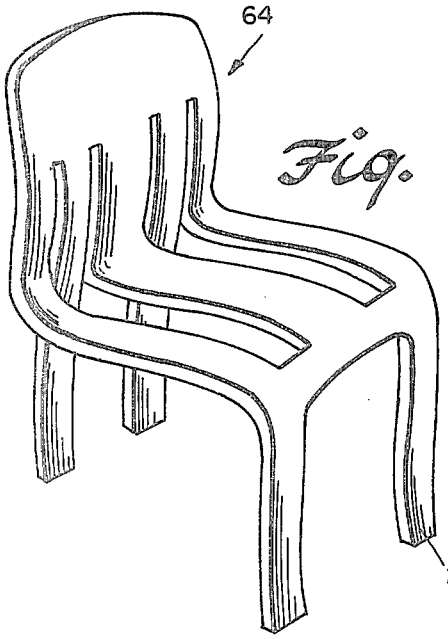
FIG. 8 is a perspective view of another chair construction.

FIG. 8 illustrates a modified form of chair 64 that is similar to the chair 10 except that no arm rest formations are provided. The chair 64 will therfore be somewhat narrower than chair 10 with its front legs 20' closer to each other. The chair 64 is otherwise the same as chair 10 and may be formed between the same bending dies 46 and 48 as hereinbefore described. The arm rest curvature surfaces 54 will be inactive in such case.

FIGS. 2 and 3 show the seat cushion core 30 to be of uniform thickness throughout. It will be appreciated that such core will be somewhat smaller than the seat panel portion 14 of the chair in a lateral direction because the core sheets 45 are cut out of the blank 32 between the front legs 20. FIGS. 9 and 10 illustrate a modified seat cushion core construction 30' utilizing the same material cut out of the blanks 32. As shown in FIG. 9, the individual sections 45 cut out of the blanks 32 are assembled so that alternate lateral edge portions are staggered to thereby form a stack having an extended lateral dimension. When such a stack of cut out sheets are molded with adhesive coatings therebetween, activated as aforementioned, to form the laminated wood core 30' shown in FIG. 10, the lateral side edge portions 66 of the core 30' will be tapered and the core will be overlapping the front leg portions to more comfortably support the chair occupant.

What is claimed is:

1. In a method of making a chair from flat sheets of material, the steps of: cutting a plurality of identical blanks from sheets of material; cutting identical sections from said blanks to form spaced leg portions in the blanks; molding said cut blanks in stacked relationship to form a laminate in the shape of the chair; molding said cut out sections in stacked relation to form a seat cushion core; and fitting the seat cushion core on the chair.

2. The method of claim 1 wherein said cut out sections are stacked in alternate staggered relation to form a core that dimensionally overlaps the speced leg portions.

3. The method of claim 1, wherein said step of molding the cut blanks includes: bending the blanks in stacked relation into a continuous curvature forming a back portion and a seat portion onto which the seat cushion core is fitted and from which the spaced front leg portions extend; and displacing a pair of tongues tangentially from the back portion to form rear legs spaced from the front leg portions.

4. A method of making a chair from a flat blank of material including the steps of:

cutting at least one internal slot in the blank to form a rear leg portion having a free unattached terminal end;

bending the cut blank into a continuous curvature under a predetermined bending pressure to form a front leg portion, a seat portion and a back portion into which the slot extends from the seat portion;

displacing the rear leg portion relative to the seat portion during said bending for extension of the rear leg portion from the back portion leaving a gap in the seat portion; and placing a seat pad on the seat portion bridging said gap.

5. The method as defined in claim 4, including the step of: finishing the rear leg portion along edges lying in parallel spaced planes by movement of planar abrasive elements through the slot cut in the blank, following said bending of the blank.

6. The method of claim 4, wherein said flat blank of material is a laminate having opposite ends and side edges, a cut-out section being removed from one of the ends to define the front leg portion along said sides laterally spaced from the rear leg.

7. A method of making a chair from a laminate having opposite ends and side edges including the steps of: cutting an internal slot in the laminate to form at least one tongue; cutting and removing a section of the laminate from one of said ends thereof to define a front leg portion along said side edges; bending the laminate into a continuous curvature form having a back portion and a seat portion extending generally transversely between the back and front leg portions; displacing the tongue from the back and seat portions only to form a rear leg separate from and laterally spaced from the front leg portion; molding said section removed from the laminate to form a seat pad; and fitting the seat pad onto the seat portion of the chair bridging the slot.

* * * * *

UNITED STATES PATENT AND TRADEMARK OFFICE

CERTIFICATE OF CORRECTION

PATENT NO. : 4,210,182

DATED : July 1, 1980

INVENTOR(S) : Peter Joseph Danko

It is certified that error appears in the above-identified patent and that said Letters Patent are hereby corrected as shown below:

Column 2, line 3, change "pool" to -- pad --.

Column 4, line 19, change "speced" to -- spaced --.

Signed and Sealed this

*Second* Day of *September 1980*

[SEAL]

*Attest:*

SIDNEY A. DIAMOND

*Attesting Officer*

*Commissioner of Patents and Trademarks*